United States Patent [19]

Mate

[11] 4,062,818

[45] Dec. 13, 1977

[54] COMPOSITION FOR IMPARTING FLAME RESISTANCE AND WATER REPELLENCY TO TEXTILES

[75] Inventor: Zoltan Mate, Upper Nyack, N.Y.

[73] Assignee: International Paper Company, New York, N.Y.

[21] Appl. No.: 561,086

[22] Filed: Mar. 21, 1975

[51] Int. Cl.[2] ..... C08L 1/26

[52] U.S. Cl. ..... 260/17 R; 260/29.6 F; 260/29.6 MP; 260/45.7 P; 260/45.7 R; 260/45.75 B; 260/45.9 R; 260/45.9 NC; 260/900; 260/901

[58] Field of Search ..... 260/17 R, 29.6 F, 29.6 MP, 260/900, 901, 45.7 P, 45.75 B, 45.9 R, 45.9 NC, 45.7 R

[56] References Cited

U.S. PATENT DOCUMENTS

| | | | |
|---|---|---|---|
| 2,917,476 | 12/1959 | Peterson et al. | 260/17.4 |
| 3,151,016 | 9/1964 | Kutik | 162/136 |
| 3,158,532 | 11/1964 | Pall et al. | 162/103 |
| 3,184,373 | 5/1965 | Arledter | 162/152 |
| 3,301,809 | 1/1967 | Goldberg et al. | 260/29.6 |
| 3,333,970 | 8/1967 | Green et al. | 106/15 |
| 3,385,904 | 5/1968 | Pavlik | 260/633 |
| 3,441,433 | 4/1969 | Michel | 117/137 |
| 3,459,696 | 8/1969 | Read | 260/28.5 |
| 3,462,296 | 8/1969 | Raynolds et al. | 260/900 |
| 3,560,318 | 2/1971 | Miller et al. | 161/82 |
| 3,620,797 | 11/1971 | Feitlowitz | 117/7 |
| 3,637,409 | 1/1972 | Hartman | 117/7 |
| 3,658,579 | 4/1972 | Ottinger et al. | 117/137 |
| 3,660,360 | 5/1972 | Ray-Chaudhuri et al. | 260/78.5 E |
| 3,676,389 | 7/1972 | Putnam et al. | 260/29.4 UA |
| 3,781,370 | 12/1973 | Anello et al. | 260/615 F |
| 3,818,074 | 6/1974 | Ahlbrecht | 260/486 |
| 3,838,104 | 9/1974 | Hayashi et al. | 260/63 HA |

OTHER PUBLICATIONS

Technical Information Paper, 3M Co., FC-808 Fluorocarbon Resin Emulsion.

*Primary Examiner*—Melvyn I. Marquis
*Attorney, Agent, or Firm*—Ronald A. Schapira

[57] ABSTRACT

An aqueous composition for imparting both flame resistance and water repellency properties to textiles, particularly non-woven textiles. The composition contains a polyvinylacetate, a chloro- or bromo-substituted phosphate plasticizer, a polyfluoroalkyl polyacrylate, water repellent, and an inorganic, water soluble salt, flame retardant.

14 Claims, No Drawings

COMPOSITION FOR IMPARTING FLAME RESISTANCE AND WATER REPELLENCY TO TEXTILES

BACKGROUND OF THE INVENTION

This invention relates to a composition for imparting both flame resistance and water repellency to textiles, particularly non-woven textiles. This invention particularly relates to a composition for imparting to a textile both: a flame resistance which satisfies the Children's Sleepwear Flammability Standard for test DOC-FF-3-71 of the U.S. Commerce Department; and, at the same time, a sufficient water repellency to hold a 4½ inch head of an aqueous, 0.9% sodium chloride solution against a glass plate for at least one hour without wetting through.

Compositions and processes for making textiles flame resistant are well known in the art. See, for example, U.S. Pat. Nos. 3,620,797, 3,333,470 and 3,676,389. The use of flame-retardant materials, incorporated into binder materials for producing non-woven fabrics, is known as an important means for dealing with the flammability of non-woven fabrics. See, in this regard, U.S. Pat. No. 3,637,409, wherein non-woven fabrics are treated with a flame retardant material (antimony trioxide) combined with a fire retardant binder material (polyvinylidene chloride), and U.S. Pat. No. 3,658,579, wherein non-woven fabrics are treated with a flame retardant material (an ammonium polyphosphate) combined with a binder material (an ethylene/vinyl chloride interpolymer) to provide a flame resistant, non-woven fabric.

However, the flame resistant textiles produced by such processes have had a relatively low level of water repellency. As a result, from the standpoint of water repellency, such flame resistant textiles have been completely unsatisfactory for many uses.

For example, flame resistant textiles have not been well suited for use in hospital garments, particularly in garments worn in hospital operating rooms. The flame retardant chemicals used in such textiles have promoted, rather than retarded, the wetting of the textiles. Because of this, such textiles have tended to absorb rather than repel moisture. The absorbed moisture has permitted infectious organisms to penetrate into and to pass through the wetted textiles. This has greatly increased the risk of infection of hospital patients wearing garments of such textiles, particularly patients undergoing surgery.

Because of the relatively poor water repellency of many flame resistant textiles, particularly flame resistant non-woven textiles, ways have been sought for imparting improved water repellency to such textiles without unduly diminishing their flame resistant properties. See, for example, U.S. Pat. Nos. 3,441,433 and 3,620,797, wherein textile materials have been treated with compositions containing both a flame retardant material and a water repellent material.

The problem with the use of such compositions, containing a water repellent material and a flame retardant material, is that, in general, the levels of flame resistance and water repellency achieved have been relatively low. In fact, the flame resistance and/or water repellency of non-woven textiles treated with heretofore available compositions have generally been considered inadequate for use in operating room garments and the like, where the dual requirements of flame resistance and water repellency have been relatively stringent.

SUMMARY OF THE INVENTION

In accordance with this invention, an aqueous composition for imparting both flame resistance and water repellency to a textile is provided, which comprises: a polyvinylacetate; a chloro- or bromo-substituted phosphate plasticizer; a polyfluoroalkyl polyacrylate, water repellent; and an inorganic, water soluble salt, flame retardant.

In accordance with another aspect of this invention, a method of imparting flame resistance and water repellency to non-woven textiles is provided, which comprises treating a partially bonded, non-woven fabric with the aqueous composition of this invention.

In accordance with still another aspect of the invention, in a flame resistant and water repellent textile, an improved composition is provided in and on the textile fibers which comprises: a polyvinylacetate; a chloro- or bromo-substituted phosphate plasticizer; a polyfluoroalkyl polyacrylate, water repellent; and an inorganic, water soluble salt, flame retardant.

The aqueous composition of this invention and the method of treating non-woven textiles with the aqueous composition provide textiles, particularly non-woven textiles, having a flame resistance which satisfies the Children's Sleepwear Flammability Standard for test DOC-FF-3-71 and a water repellency which is sufficient to hold a 4½ inch head of a 0.9% salt solution for at least one hour without wetting through, thereby rendering the textiles suitable for use in hospital operating room garments.

DETAILED DESCRIPTION OF THE INVENTION

In accordance with this invention, an aqueous composition for imparting both flame resistance and water repellency to a textile, particularly a non-woven textile, is provided which comprises: one or more polyvinylacetates; one or more, chloro- or bromo-substituted phosphate plasticizers; one or more, polyfluoroalkyl polyacrylate, water repellents; and one or more, inorganic, water soluble salt, flame retardants.

In the composition of this invention, any conventional vinylacetate polymer, which can be suspended in water, preferably as a free flowing latex, and which can serve as a binder for the fibers in a non-woven textile, can be utilized. Among the polyvinylacetates which can be utilized are the conventional homopolymers, formed, for example, by the polymerization of vinylacetate with a peroxide catalyst. Also among the useful polyvinylacetates are vinylacetate copolymers such as are disclosed in U.S. Pat. No. 3,301,809. Suitable polyvinylacetates are available as latexes under the trade names Resyn 1066 and X-link 2828, from National Starch and Chemical Corp., 750 Third Avenue, New York, N.Y. 10017. Preferably, when preparing the composition of this invention, a polyvinylacetate latex is used.

In the composition of this invention, any conventional chloro- or bromo-substituted phosphate plasticizer, including a chloro- and bromo-substituted phosphate plasticizer, which is compatible with the polyvinylacetate can be utilized. Among the chloro- or bromo-substituted phosphate plasticizers which can be used are the trichloroethyl phosphate of U.S. Pat. No. 3,658,579 and the 2,3-dibromopropyl phosphate ammonium salts of U.S. Pat. No. 3,676,389. The preferred chloro- or bromo-substituted phosphate plasticizer is tris-(2,3-dibromopropyl) phosphate, available under the trade name Firemaster T 23 P, from Michigan Chemical Corp., 351 West Ohio Street, Chicago, Ill. 60611.

In the composition of this invention, it is particularly preferred that the chloro- or bromo-substituted phosphate plasticizer be mixed with an emulsifier, such as hydroxyethyl cellulose, to promote the mixing of the plasticizer and the polyvinylacetate latex. For this purpose, any conventional emulsifier which is compatible with the plasticizer and the polyvinylacetate latex can be utilized. The preferred emulsifier is carboxymethyl cellulose, available from Hercules Powder Company, Wilmington, Del.

In forming the aqueous composition of this invention, the polyvinylacetate latex is mixed with the chloro- or bromo-substituted phosphate plasticizer and the emulsifier. Preferably, this mixture is prepared with about one part by weight of the polyvinylacetate and about 1.5 to 3 parts, preferably about two parts, by weight of a mixture of the chloro-or bromo-substituted phosphate plasticizer and the emulsifier. The mixture of the plasticizer and the emulsifier preferably includes about one hundred parts by weight of the plasticizer and about 0.5 to 1 parts, preferably about 0.65 parts, by weight of the emulsifier. The resulting mixture of polyvinylacetate, plasticizer and emulsifier preferably comprises about fifty to seventy percent by weight solids, particularly about sixty percent solids, with the remainder being water. However, the proportions of these ingredients and the relative percentages of solids and water are not critical and can be varied widely in the flameproofing and waterproofing composition of this invention.

The use of the polyvinylacetate and the chloro- or bromo-substituted phosphate plasticizer is considered critical in the aqueous composition of this invention. It has been found that these materials are uniquely adapted to be suspended in the aqueous composition and to impart flame retardance to a treated textile without unduly interfering with the waterproofing characteristics of other ingredients utilized in the composition.

If desired, in the aqueous composition of this invention, a pigment can be used. In this composition, any conventional non-ionic pigment which can be dispersed in the aqueous composition and which does not unduly interfere with the other ionic ingredients in the formulation can be utilized. Among the useful non-ionic pigments are those available under the trade name Imperse, from Hercules Powder Company, Wilmington, Del. The Imperse non-ionic pigments can be mixed with water, using an emulsifying agent such as carboxymethyl cellulose, and the resulting aqueous dispersion of the pigment can be suitably mixed with the aqueous composition of this invention. The pigment can be suitably utilized in an amount of up to about one part by weight per part by weight of the polyvinylacetate.

In the flameproofing and waterproofing, aqueous composition of this invention, the polyfluoroalkyl polyacrylate, water repellent can be any water repellent which contains a polymerized polyfluoroalkyl acrylate monomer and is compatible with the other ingredients in the composition. For example, the water repellent can be a polyfluoro aliphatic alcohol polyacrylate, such as is described in U.S. Pat. No. 3,441,433. Alternatively, the water repellent can be a linear copolymer of a perfluoroalkyl acrylate and a polyoxyalkylene acrylate. A weakly cationic, aqueous emulsion containing 20% by weight of a linear copolymer of a perfluoroalkyl acrylate and a polyoxyalkylene acrylate is available under the trade name Scotchban FC-808 from the 3M Company, St. Paul, Minn. 55101.

In the composition of this invention, any polyfluoroalkyl polyacrylate, water repellent can be utilized so long as: (1) it is capable of imparting, to a textile treated with the composition, a water repellency sufficient to hold a four and one-half inch head of an aqueous, 0.9% (by weight) sodium chloride solution against a horizontal glass plate for at least one hour without wetting through the textile; and (2) in the amounts used, it does not prevent the treated textile from having a flame resistance within the Children's Sleepwear Flammability Standard for Test DOC-FF-3-71 of the U.S. Department of Commerce. In this flame test, a number of strips of a fabric ten inches long and three inches wide are held in a vertical position and ignited. In order to pass this flame test, after twelve seconds of ignition with a bunsen burner, the char length of each fabric strip should not exceed 7 inches.

The preferred polyfluoroalkyl polyacrylate, water repellent of this invention is Scotchban FC-808. When the aqueous composition of this invention contains this particular water repellent emulsion material in a ratio of only about 0.75 to 2.5 parts by weight (i.e., about 0.15 to 0.5 parts by weight of the linear copolymer of a perfluoroalkyl acrylate and a polyoxyalkylene acrylate, water repellent), preferably only one part by weight (i.e., about 0.2 parts by weight of the linear copolymer of a perfluoroalkyl acrylate and a polyoxyalkylene acrylate, water repellent), per part by weight of the polyvinylacetate, the foregoing required levels of flame resistance and water repellency are obtained or exceeded in treated textiles.

In the composition of this invention, any inorganic, water-soluble salt, flame retardant can be utilized. Among the salt flame retardants which can be used are the spumifics disclosed in U.S. Pat. No. 2,917,476, such as the ammonium phosphates, ammonium sulphate, ammonium bromide, and sodium borate; antimony trioxide; the foaming agents disclosed in U.S. Pat. No. 3,676,389, such as the alkali metal halides, the ammonium halides, and ammonium thiocyanate; and the ammonium polyphosphates of U.S. Pat. No. 3,658,579. The preferred, inorganic, water soluble salt, flame retardants are the ammonium phosphates, such as monoammonium phosphate. Preferably, the inorganic, salt flame retardant is mixed with one or more, basic, flame retardant, buffer materials. Among the basic, flame retardant, buffer materials which can be used in combination with the inorganic, salt flame retardants are the organic nitrogen compounds, such as are disclosed in U.S. Pat. No. 2,917,476, e.g., urea, dimethyl urea, thiourea, and dicyandiamide.

In the aqueous composition of this invention, the inorganic, water soluble salt, flame retardant is preferably utilized in an amount equal to about 0.2 to 0.4, preferably about 0.3, parts by weight per part by weight of the polyvinylacetate. The flame retardant buffer material is preferably utilized in an amount of about 0.75 to 1.5, preferably one, parts by weight per part by weight of the inorganic, water-soluble salt, flame retardant.

In the aqueous composition of the invention, particular amounts of the ingredients, including water, are not critical. For example, the amount of water in the composition can suitably comprise about thirty to seventy percent by weight, preferably about forty to fifty percent by weight. However, the relative amounts of polyvinylacetate, chloro- or bromo-substituted phosphate plasticizer, polyfluoroalkyl polyacrylate, water repellent and inorganic, water soluble salt, flame retardant in the composition must be closely regulated to assure 1. that the ingredients in the composition do not separate or precipitate;
2. that the composition has a flame retardance adequate to enable a treated fabric to pass the Children's Sleepwear Flammability Standard for Test DOC-FF-3-71; and
3. that the composition has a water repellency adequate to enable a treated fabric to hold a 4½ inch head of a 0.9% salt solution against a glass plate for one hour without wetting through.

In preparing the aqueous composition of this invention, it is preferred that: a mixture of water, the polyvinylacetate latex, the chloro- or bromo-substituted, phosphate plasticizer, the pigment (if desired) and the polyfluoroalkyl acrylate, water repellent be prepared; a mixture of water and the inorganic, salt flame retardant, preferably containing the buffer material, be prepared; and then, the two aqueous mixtures be combined.

The textile which is being flameproofed and waterproofed by the aqueous composition of this invention can be any conventional, natural or synthetic, woven, non-woven, or knit textile. The aqueous composition of this invention is preferably utilized for treating a non-woven textile, such as is generally disclosed in U.S. Pat. Nos. 3,620,797, 3,637,409 and 3,658,579.

In treating a textile, particularly a non-woven textile, with the aqueous composition of this invention, sufficient amounts of the aqueous composition are utilized so that the deposition of solids from the composition in and on the textile fibers is at least about 1.4 ounces per square yard of textile. Preferably, the amount of aqueous composition utilized is such that not more than 4 ounces, especially about about 1.6 to 2.2 ounces, of solids from the aqueous composition per square yard of textile are deposited in and on the textile fibers. In treating a textile with the aqueous composition, it is also preferred that the textile be saturated with the aqueous composition (i.e., 100% wet pick-up). As a result, the wet pick-up of the textile fiber, in accordance with this invention, is preferably at least 2 ounces per square yard of textile when utilizing an aqueous composition of this invention containing 30% water and at least 3½ to 4 ounces per square yard of textile when using an aqueous composition of this invention of 60 to 65% water.

The aqueous composition of this invention is particularly useful in the second step of a two step process for impregnating non-woven textiles with binder materials, such as is disclosed in U.S. Pat. No. 3,637,409. In such a second impregnation step, a partially bonded, non-woven textile web is immersed in the aqueous composition of this invention. The polyvinylacetate of the aqueous composition acts as a binder, in combination with the primary binder (e.g., a foamed, acrylic latex) from the first, pre-bonding step, to bond the individual textile fibers together to form a non-woven textile web. In this second impregnation step, the time of immersion and the degree of wetting of the non-woven textile is not critical. The resulting non-woven textile is then squeezed to remove the excess aqueous composition and dried. The resulting, non-woven textile web is thereby rendered flame resistant and water repellent, i.e., the textile can pass the Children's Sleepwear Flammability Standard for test DOC-FF-3-71 and can hold a 4½ inch head of a 0.9% salt solution against a glass plate for one hour without wetting through.

The composition of this invention also can be advantageously utilized for purposes other than a second impregnation of a non-woven textile with a binder. In fact, the composition of this invention can be suitably utilized wherever a curable binder and enhanced flame resistance and water repellency are useful in a textile. For example, it can be used in a one step impregnation of a non-woven textile, such as is disclosed in U.S. Pat. No. 3,620,797 and U.S. Pat. No. 3,658,579. In such a one step impregnation, the polyvinylacetate acts as the sole binder for the individual fibers.

All of the ingredients in the aqueous composition of this invention coact to provide relatively high levels of flame resistance and water repellency. This is considered very important since, in general, the effects of flameproofing materials and waterproofing materials are antagonistic. The particular flame retardant and water repellent materials utilized in the composition of this invention are uncharacteristically compatible. The principal reason for their compatibility is believed to be the presence of the polyvinylacetate in the aqueous composition of this invention.

An example of a preferred aqueous composition of this invention contains the following ingredients: 4,000 parts (by weight) water: 4,000 parts polyvinylacetate latex (61.3% solids), which contains one part polyvinylacetate, two parts tris-(2,3-dibromopropyl) phosphate (as plasticizer) and 0.013 parts carboxymethyl cellulose (as emulsifier); 55 parts non-ionic, pigment dispersion (70 percent water); 800 parts Scotchban FC-808, water repellent emulsion (80 percent water); 200 parts dicyandiamide and 200 parts urea (as buffers); and 400 parts monoammonium phosphate (as inorganic, salt flame retardant). If desired, the amounts of the individual ingredients in this preferred composition can be varied by up to about ± 10% to provide a composition suitable as a binder for non-woven textiles and for imparting relatively high levels of flame resistance and water repellency to textiles generally. The preferred composition is preferably prepared by combining with continuous mixing:

an aqueous mixture of 1600 parts water, the polyvinylacetate latex, the pigment dispersion, and the water repellent emulsion; and an aqueous mixture of 2400 parts water, the buffers and the salt flame retardant.

It is thought that the instant invention and many of its attendant advantages will be understood from the foregoing description and it will be apparent that various changes may be made in the matter of the ingredients, their identity and their proportions without departing from the spirit and scope of the invention or sacrificing all of its material advantages, the form hereinbefore described being merely a preferred embodiment thereof.

I claim:

1. An aqueous composition for treating a fabric comprising, as ingredients:

a polyvinylacetate; a chloro- or bromo-substituted phosphate plasticizer; a polyfluoroalkyl polyacrylate, water repellent; and an inorganic, water soluble salt, flame retardant;

the relative amounts of said ingredients in said composition being such that said ingredients do not separate or precipitate from said composition;

said composition having a flame retardance adequate to enable a treated fabric to pass the Children's Sleepwear Flammability Standard for Test DOC-FF-3-71; and said composition having a water repellency adequate to enable a treated fabric to hold a 4½ inch head of an aqueous 0.9% sodium chloride solution against a glass plate for one hour without wetting through.

2. The aqueous composition of claim 1 wherein the inorganic, salt flame retardant is mixed with a basic, flame retardant, buffer material.

3. The aqueous composition of claim 2 wherein the buffer material is an organic nitrogen compound.

4. The aqueous composition of claim 2 wherein the plasticizer is tris-(2,3-dibromopropyl) phosphate.

5. The aqueous composition of claim 2 wherein the plasticizer is mixed with an emulsifier.

6. The aqueous composition of claim 5 wherein the emulsifier is carboxymethyl cellulose.

7. The aqueous composition of claim 2 wherein the water repellent is a copolymer of a perfluoroalkyl acrylate and a polyoxyalkylene acrylate.

8. The aqueous composition of claim 2 wherein the inorganic, salt flame retardant is an ammonium phosphate.

9. The aqueous composition of claim 2 which includes:

about one part by weight of the polyvinylacetate;

about 1.5 to 3 parts by weight of the chloro- or bromo-substituted phosphate plasticizer;

about 0.2 to 0.4 parts by weight of the inorganic, salt flame retardant; and about 0.15 to 0.6 parts by weight of the basic, flame retardant, buffer material.

10. The aqueous composition of claim 9 which includes about 0.15 to 0.5 parts by weight of a linear copolymer of a perfluoroalkyl acrylate and a polyoxyalkylene acrylate, water repellent.

11. The aqueous composition of claim 10 which comprises about 40 to 50 percent by weight of water.

12. The aqueous composition of claim 11 which comprises:

about 1 part by weight of the polyvinylacetate;

about two parts by weight of the chloro- or bromo-substituted phosphate plasticizer;

about 0.2 parts by weight of the linear copolymer of a perfluoroalkyl acrylate and a polyoxyalkylene acrylate, water repellent;

about 0.3 parts by weight of the inorganic, salt flame retardant; and about 0.3 parts by weight of the basic, flame retardant, buffer material.

13. The aquous composition of claim 10 wherein the plasticizer is tris-(2,3-dibromopropyl) phosphate and the buffer material is an organic nitrogen compound.

14. The aqueous composition of claim 13 wherein the inorganic, salt flame retardant is an ammonium phosphate.

* * * * *